US006886965B2

(12) United States Patent
Hoffbauer

(10) Patent No.: US 6,886,965 B2
(45) Date of Patent: May 3, 2005

(54) LIGHT FIXTURE WITH TRANSLUCENT SHADE

(75) Inventor: Bernd Hoffbauer, Herne (DE)

(73) Assignee: Herner Glas Bernd Hoffbauer GmbH & Co. Leuchten und Industrieglas KG, Herne (DE)

( * ) Notice: Subject to any disclaimer, the term of this patent is extended or adjusted under 35 U.S.C. 154(b) by 23 days.

(21) Appl. No.: 10/323,872

(22) Filed: Dec. 18, 2002

(65) Prior Publication Data

US 2003/0123257 A1 Jul. 3, 2003

(30) Foreign Application Priority Data

Jan. 3, 2002 (DE) ..... 102 00 034

(51) Int. Cl.[7] ..... F21S 13/10; F21V 3/00

(52) U.S. Cl. ..... 362/363; 362/311; 362/350; 362/806; 362/351; 362/339

(58) Field of Search ..... 362/311, 350, 362/351, 352, 367, 806, 363, 104, 571, 253, 355, 356, 358, 410, 414, 339; D26/128, 125, 130, 135, 136; 40/554

(56) References Cited

U.S. PATENT DOCUMENTS 579,350 A * 3/1897 Pennycuick ..... 362/339
1,592,561 A * 7/1926 Godley ..... 362/339
D299,703 S * 2/1989 Arai ..... D10/114
5,408,396 A * 4/1995 Stanley ..... 362/253
D426,342 S 6/2000 Hoffbauer

FOREIGN PATENT DOCUMENTS

DE 44 42 584 1/1996
DE 198 01 568 3/2000

* cited by examiner

*Primary Examiner*—Stephen Husar
*Assistant Examiner*—Sharon Payne
(74) *Attorney, Agent, or Firm*—Herbert Dubno; Andrew Wilford

(57) ABSTRACT

A light fixture has an electrical light-emitting lamp, a hollow and at least partially light-transparent shade spacedly surrounding the lamp and formed with a throughgoing hole having an inner edge, and a transparent prismatic jewel generally filling the hole and having a faceted outer surface turned away from the lamp and an inner surface turned toward the lamp. This jewel is fixedly retained in the hole such that light emitted by the lamp impinges the jewel inner surface, passes through the jewel, and is emitted from the jewel outer surface.

8 Claims, 3 Drawing Sheets

LIGHT FIXTURE WITH TRANSLUCENT SHADE

FIELD OF THE INVENTION

The present invention relates to a light fixture. More particularly this invention concerns a light fixture with an at least partially transparent shade.

BACKGROUND OF THE INVENTION

A light fixture having an electrical light-emitting lamp and a hollow and at least partially light-transparent shade spacedly surrounding the lamp is described in German patent 198 01 568 and U.S. design Pat. No. 426,342 of B. Hoffbauer. The shade is formed on diametrally opposite sides with throughgoing holes to which is fitted an arcuate translucent rod of glass or acrylic. This rod is directly aligned with the lamp and serves to diffuse and distribute light in a visually attractive and interesting manner. It in fact projects past the lower edge of the shade so that it throws light to the sides, effectively acting as a secondary light source.

German patent 44 42 584 of G. Chmielewski describes a downwardly globe having an upper portion that is translucent or frosted and a lower portion that is perfectly transparent. A lens is fitted inside this globe between the two portions and is itself formed of transparent material, with a faceted face so that it collects, refracts, and distributed light cast on it by a lamp inside the globe. The visual effect produced by a light fixture incorporating this globe is quite interesting.

Both these structures are fairly complex and somewhat difficult to install. The light-diffusing rod and the faceted lens both are separate parts that must be installed with care and kept track of prior to installation.

OBJECTS OF THE INVENTION

It is therefore an object of the present invention to provide an improved light fixture.

Another object is the provision of such an improved light fixture which overcomes the above-given disadvantages, that is which is of simple construction yet which produces an interesting and attractive lighting effect.

SUMMARY OF THE INVENTION

A light fixture has according to the invention an electrical light-emitting lamp, a hollow and at least partially light-transparent shade spacedly surrounding the lamp and formed with a throughgoing hole having an inner edge, and a transparent prismatic jewel generally filling the hole and having a faceted outer surface turned away from the lamp and an inner surface turned toward the lamp. This jewel is fixedly retained in the hole such that light emitted by the lamp impinges the jewel inner surface, passes through the jewel, and is emitted from the jewel outer surface.

Normally a plurality or such jewels are provided, uniformly distributed around the shade, so that the fixture has an extremely attractive appearance. Each jewel can refract the light it receives to produce a particularly pleasing effect. They break up the otherwise uniform surface of the shade, making its appearance much more interesting. Both the shade and the jewel can be made of glass or an acrylic. The jewel is perfectly transparent while the shade is normally only partially transparent, that is frosted or translucent. Opal glass is particularly suited for the shade, as that provides a good contrast with the clear jewel.

According to the invention wherein the jewel fits at least partially into the hole. It is surrounded by the edge, normally spacedly. Such a jewel is held in place by a plurality of clips fixed to the shade and bearing on the jewel. The clips can themselves be decorative and arranged symmetrically to enhance the appearance of the fixture.

According to another feature of the invention the jewel bears at the edge against an outer surface of the shade. In this case it is held in place by a ring of adhesive between the outer shade surface and the jewel. In this system there is no gap between the jewel and the hole edge so no light escapes from the shade around the jewel; it either passes through the shade or through the jewel. To enhance the effect the adhesive is transparent.

The jewel according to the invention projects through the hole past an inner surface of the shade. In addition the shade is translucent and rotation symmetrical.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
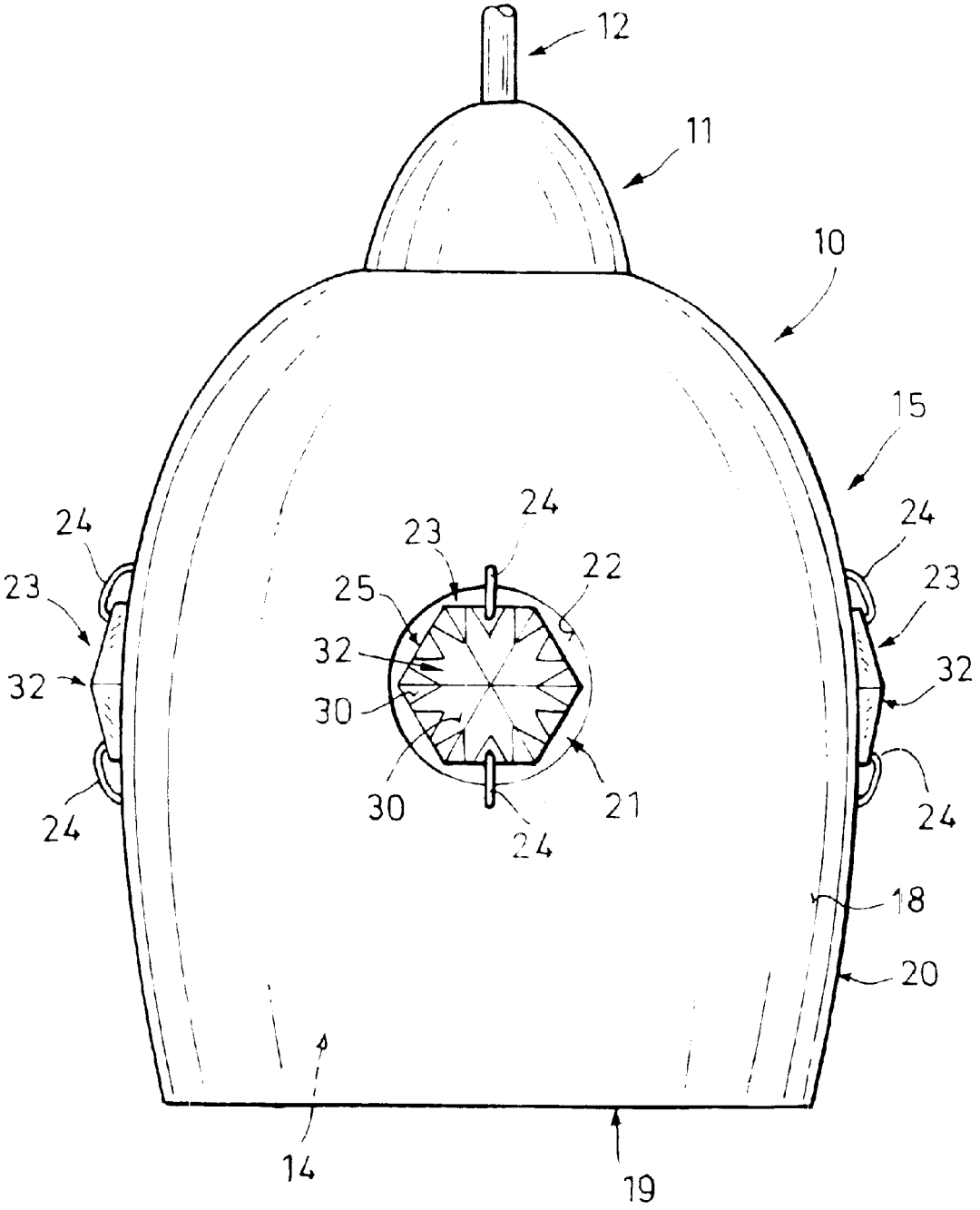
FIG. 1 is a side view of a light fixture according to the invention.
Figure 2:
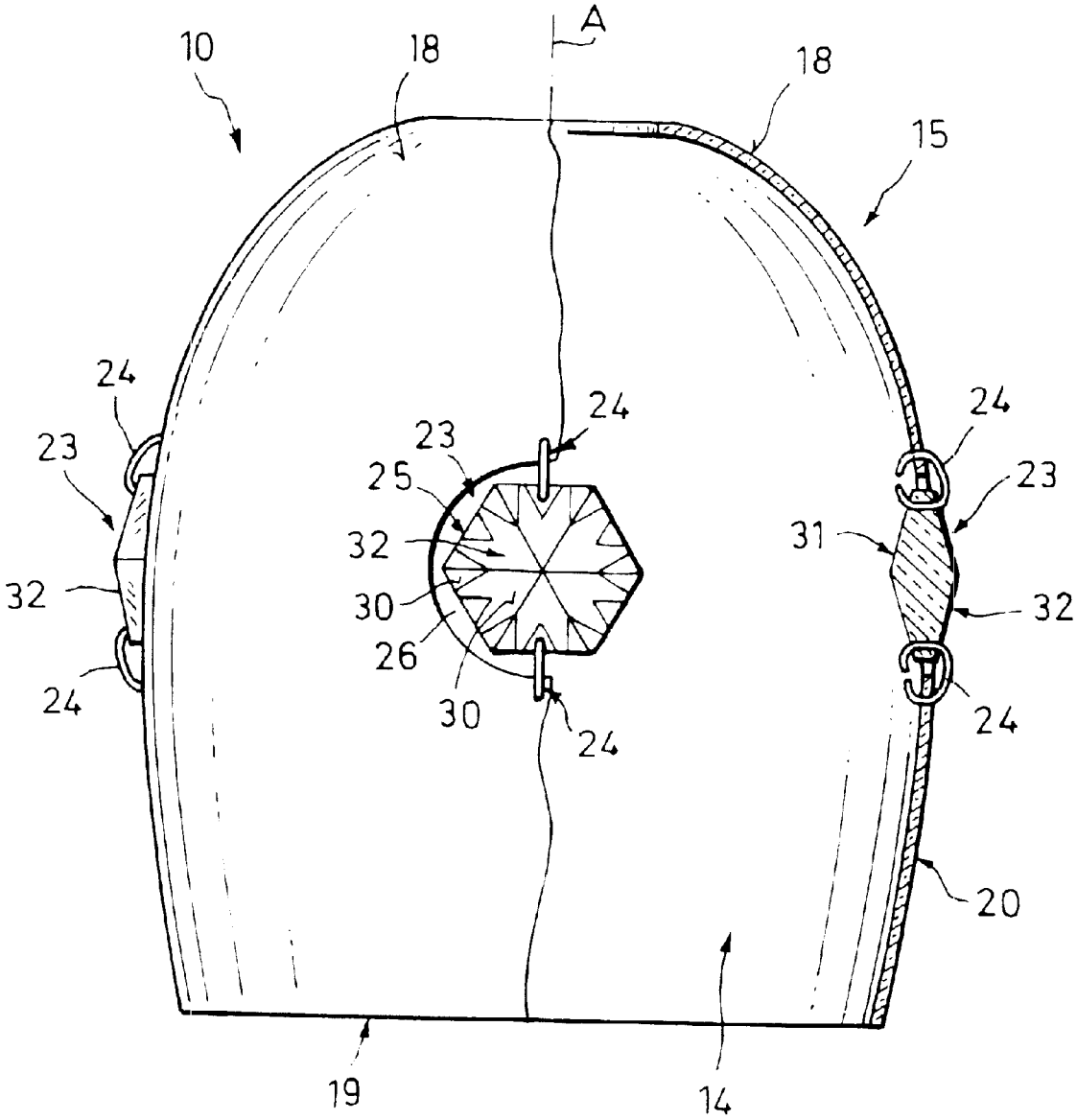
FIG. 2 is a side partly sectional view of the shade of the fixture of FIG. 1.

As seen in FIGS. 1 and 2 a light fixture 10 according to the invention is symmetrical to a vertical axis A and has a shade 10, a holder 11 for a halogen lamp 13 (FIG. 3 only), and a cable 12 which supplies electricity to the lamp 13 and by means of which the fixture 10 is hung. A shade 15 has an interior 14 in which the lamp 13 is centered.

Figure 3:
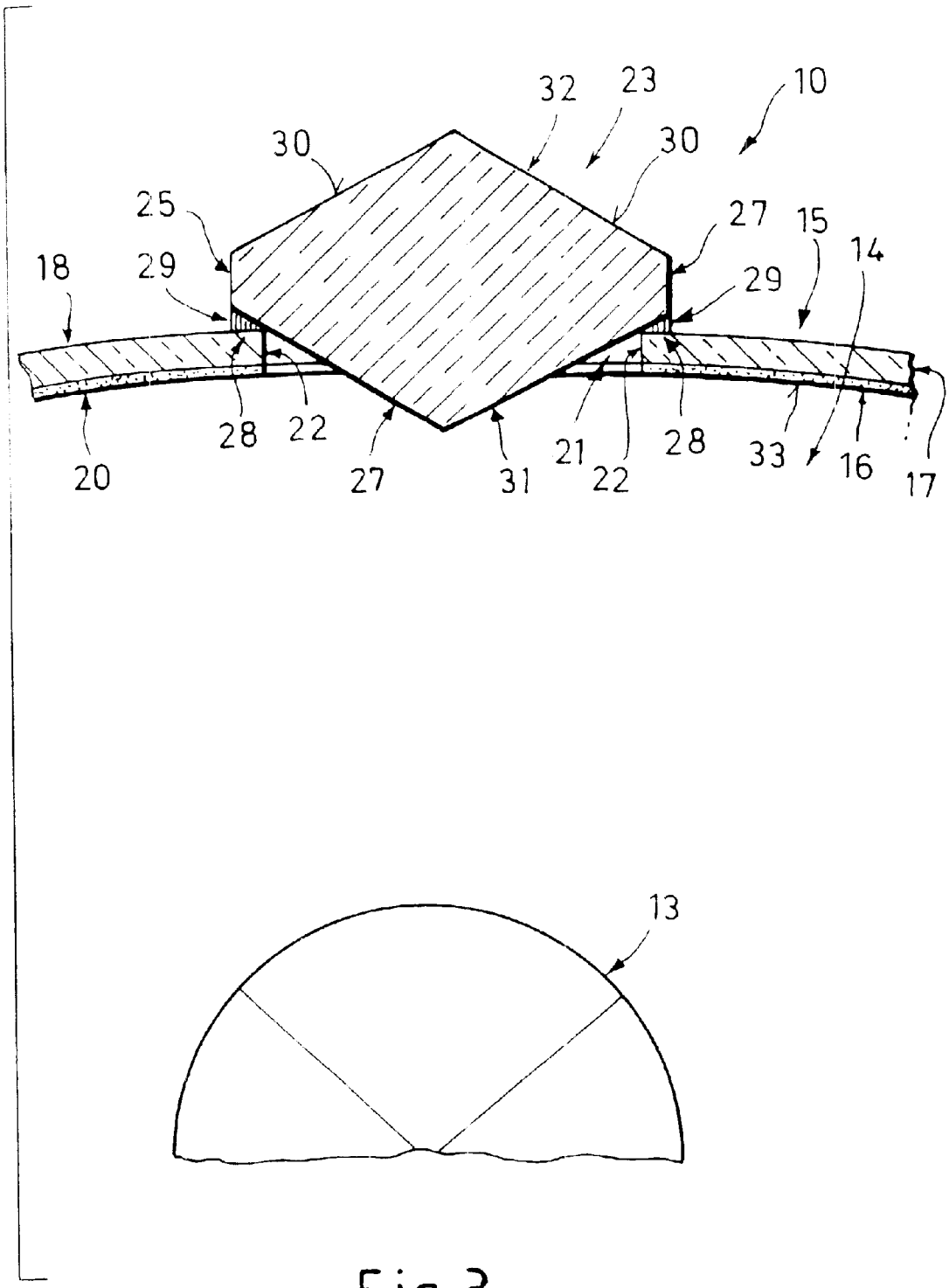
FIG. 3 is a partial horizontal section through another embodiment of the light fixture in accordance with the invention.

The shade 15 has as shown in FIG. 3 an opal-glass interior layer 16 defining an inner surface 33 and a thicker clear-glass outer layer 17 defining an outer surface 18. It is formed with four angularly equispaced throughgoing circular apertures or holes 21 having inner edges 22 and in which are set jewels 23 that are of faceted hexagonal shape and made of clear glass or acrylic. Each jewel 23 has an outer surface 32 that is what is seen from outside the fixture 10 and an inner surface 31 that is exposed through the hole 21 to the light emitted by the lamp 13. Facets 30 of the jewels 23 diffract and spread the light cast on the respective inner surfaces 31. Thus each jewel 23 in effect forms a secondary light source.

In the arrangement of FIGS. 1 and 2 the jewel 23 is smaller than the hole 21 so that its outer periphery 25 is separated by a space 26 from the cylindrical edge 22. Two clips 24 formed as wire loops or rings passing through holes in the jewels 23 and shade 15 secure the jewels 23 in the centers of the holes 21.

In FIG. 3 the jewel 23 is of larger size so its outer periphery 25 overlaps the edge 22 and forms with the outer surface 18 at the edge 22 a gap 28 filled with a transparent adhesive 29 that serves as the means securing the jewel 23 in place on the shade 15.

I claim:

1. A light fixture comprising:

an electrical light-emitting lamp;

a hollow and at least partially light-transparent shade spacedly surrounding the lamp and formed with a throughgoing hole having an inner edge;

a transparent prismatic jewel generally filling and fitting at least partially into the hole and having a faceted outer surface turned away from the lamp and an inner surface turned toward the lamp, the jewel being spacedly surrounded by the edge; and means fixedly retaining the jewel in the hole such that light emitted by the lamp impinges the jewel inner surface, passes through the jewel, and is emitted from the jewel outer surface.

2. The light fixture defined in claim 1 wherein the means includes a plurality of clips fixed to the shade and bearing on the jewel.

3. The light fixture defined in claim 1 wherein the shade is translucent.

4. The light fixture defined in claim 1 wherein the shade is centered on and rotation symmetrical to an axis.

5. A light fixture comprising:

an electrical light-emitting lamp;

a hollow and at least partially light-transparent shade spacedly surrounding the lamp and formed with a throughgoing hole having an inner edge;

a transparent prismatic jewel generally filling the hole, having a faceted outer surface turned away from the lamp and an inner surface turned toward the lamp, and bearing at the edge against an outer surface of the shade; and means fixedly retaining the jewel in the hole such that light emitted by the lamp impinges the jewel inner surface, passes through the jewel, and is emitted from the jewel outer surface.

6. The light fixture defined in claim 5 wherein the means is a ring of adhesive between the outer shade surface and the jewel.

7. The light fixture defined in claim 6 wherein the adhesive is transparent.

8. A light fixture comprising:

an electrical light-emitting lamp;

a hollow and at least partially light-transparent shade spacedly surrounding the lamp and formed with a throughgoing hole having an inner edge;

a transparent prismatic jewel generally filling the hole, having a faceted outer surface turned away from the lamp and an inner surface turned toward the lamp, and projecting through the hole past an inner surface of the shade; and means fixedly retaining the jewel in the hole such that light emitted by the lamp impinges the jewel inner surface, passes through the level, and is emitted from the jewel outer surface.

* * * * *